United States Patent [19]

Azzar

[11] Patent Number: 4,971,849

[45] Date of Patent: Nov. 20, 1990

[54] READILY BENDABLE EXTRUDED ELASTOMERIC TRIM STRIP

[75] Inventor: James D. Azzar, Grand Rapids, Mich.

[73] Assignee: Extrusions Division, East Grand Rapids, Mich.

[21] Appl. No.: 393,348

[22] Filed: Aug. 14, 1989

[51] Int. Cl.[5] ..... B32B 3/02; B32B 3/06

[52] U.S. Cl. ..... 428/100; 52/829; 248/345.1; 428/192

[58] Field of Search ..... 52/716, 829; 248/345.1; 428/100, 192, 31

[56] References Cited

U.S. PATENT DOCUMENTS

| | | | |
|---|---|---|---|
| 3,303,626 | 2/1967 | Brigham | 52/586 |
| 3,308,598 | 3/1967 | Wilson | 52/511 X |
| 3,494,244 | 2/1970 | Wayland | 24/453 X |
| 3,706,173 | 12/1972 | Taylor | 428/122 X |
| 3,953,661 | 4/1976 | Gulley | 428/168 X |
| 4,370,373 | 1/1983 | Janicz | 428/151 |
| 4,558,553 | 12/1985 | Kolk | 52/829 |
| 4,749,203 | 6/1988 | Bright | 428/122 X |
| 4,769,966 | 9/1988 | Petri | 52/716 |
| 4,810,550 | 3/1989 | Gasser | 428/100 |

*Primary Examiner*—Henry F. Epstein

*Attorney, Agent, or Firm*—Sughrue, Mion, Zinn, Macpeak & Seas

[57] ABSTRACT

An elongated, extruded, flexible elastomeric material protective edge member of T-shaped cross-sectional configuration for attachment to a curved edge of an article of furniture having a narrow, elongated groove within that edge and having a barbed flange projecting at right angles from the base at the center thereof is provided with a plurality of longitudinally spaced transverse slots formed within the barbed flange from the edge of the barbed flange remote from the base in the direction of the base to permit inward and outward bending of the trim strip through the plane of the barbed flange. Transverse grooves are provided within the rear surface of the base as extensions to the slots within the barbed flange over the portion of the trim strip to be bent to conform to curved portions of said article of furniture edge during coupling thereto. The transverse grooves extend preferably beyond the opposite sides of the barbed flange. Additionally, a longitudinal groove is provided within said rear surface of the base along the side of the barbed flange, extending parallel thereto and intersecting the transverse grooves to enhance the flexibility of the elastomeric material protective edge member to reduce resistance in bending of the base, to conform the trim strip to inner bends of the curved edge of the article of furniture during attachment of the trim strip to such article.

7 Claims, 2 Drawing Sheets

READILY BENDABLE EXTRUDED ELASTOMERIC TRIM STRIP

FIELD OF THE INVENTION

This invention relates to flexible continuously extruded elastomeric trim strip for edge trimming planar members of articles of furniture such as table tops, desk tops, counter tops and the like, and more particularly to an improved T-shaped elastomeric extrusion which is readily bendable in two directions through the plane of a barbed flange to follow the irregular curved edges of the planer member through both inside and outside curves.

DESCRIPTION OF THE PRIOR ART

In recent years, protective edge members or trim strips of mushroom shaped configuration are formed of a dome-shaped base or head from which projects a barbed flange at right angles to the head and perpendicular to a flat face thereof as an extruded elastomeric trim strip and mountable to the edge of a planar member of an article of furniture such as a table, desk or counter top. The planar member has an elongated groove within its edge of the planar member sized in width, slightly smaller than the barbed flange to receive the same and to lock the trim strip to the edge of the furniture planar member. Representative U.S. Patents showing such protective table edge trim strips are U.S. Pat. No. 4,370,373 to Janicz, issued Jan. 25 1983 and U.S. Pat. No. 4,810,550 to Gasser, issued Mar. 7, 1989.

Where the planar member has straight edges, there is no difficulty in mounting of the trim strip to the edge of the furniture planar member. Where such edge is curved, in forcing the trim strip material to follow the curvature of the furniture planar member edge, the base or head as well as the barbed flange tend to pucker and the curvature of the trim strip material becomes uneven. Necessarily, the trim strip must be modified to facilitate the curving of the trim strip to follow that of the furniture planar member edge. Conventionally, the barbed flange of such trim strip is provided with a series of longitudinally spaced slots within the barbed flange from the edge remote from the base towards the base, which slots may be of U-shaped configuration, V-shaped or otherwise.

In the molding or trim strip art generally, the utilization of such slots within portions of the molding or trim strip material to permit and enhance curvature, particularly over a relatively sharp radius are evidenced by U.S. Pat. Nos. 3,308,598 to Wilson issued Mar. 14, 1967; 3,706,173, to Taylor issued Dec. 19, 1972; 4,749,203, to Bright issued June 7, 1988, and 4,769,966 issued to Petri Sept. 13, 1988.

Where the trim strip takes the form of a unitary, continuous extrusion of elastomeric material of generally mushroom shaped cross-sectional configuration, the presence of uniformed spaced V-shaped slots or rectangular slots longitudinally along the barbed flange of the portions of the extruded strip which must be bent to follow the curved edge of the planar member of the article of furniture supporting the same by force fitting of the barbed flange into the elongated groove within the edge of the article planar member, the existence of the slot within the barbed flange has been found to facilitate bending of the extruded elastomeric trim strip about outside bend corners of the planar member curved edge. Under these conditions, the outer surface of the trim strip base is subject to tensioning during such bending. However, in attempting to oppositely bend the elastomeric extruded trim strip to conform to an inside bend or corner of the planar member curved edge, greater resistance to bending is encountered since that outer surface of the extrusion head or base is subjected to compression.

It is, therefore, a primary object of the present invention to provide a readily bendable extruded elastomeric trip strip of mushroom shaped cross-section which may be bent with equal ease and in both directions through the plane of the barbed flange projecting at right angles from the flat surface of the trim strip base and at the center thereof in which the trim strip material is maintained taut, both the head and barbed flange thereof is free of unevenness and puckering, and wherein irrespective of whether the extruded elastomeric trim strip is subjected to inner curve or outer curve bending, the curvature of the strip is smooth and regular, and follows exactly the curved edge of the planar member of the article of furniture bearing the same.

SUMMARY OF THE INVENTION

The present invention constitutes an improvement in a trim strip for protecting a planar member of an article of furniture having an irregular curved edge with a narrow, elongated groove within that edge at right angles to the face of the planar member at said edge. The trim strip comprises an elongated, extruded elastomeric protective edge member having a first portion or base with a flat surface for contact with the irregular, curved outer edge of the furniture planar member, and a second integral portion in the form of an integral barbed flange projecting outwardly of the first flat surface of said base, along the length thereof and sized slightly in excess to the width of the elongated groove for force fitting therein. The integral barbed flange is provided with a plurality of longitudinally uniformly spaced slots over a portion of the trim strip extending from the edge of the barbed flange remote from the first portion towards said first portion for facilitating bending of the trim strip in the plane of the barbed flange. Within such trim strip, the invention is directed to the improvement wherein said transverse slots are extended into the flat surface of the elastomeric edge member over the full width of the barbed flange, and extending beyond at least one side of said barbed flange as a shallow transverse groove, and wherein said flat surface of said base further includes a groove extending longitudinally over the span of at least several of said transverse grooves, intersecting said transverse grooves and parallel to the side of said barbed flange whereby bending of said extruded elongated elastomeric protective edge member in both directions through the plane of said barbed flange is substantially enhanced.

The longitudinally extending groove within the flat surface of said base preferably intersects the ends of the transverse grooves within said base flat surface remote from said barbed flange. The elongated, extruded elastomeric protective edge member may have a hardened surface layer and a soft interior section of different diameter hardness with the transverse grooves and longitudinal grooves within the flat surface of the base extending completely through the hardened surface layer to increase the flexibility of the trim strip extruded elongated elastomeric protective edge member in the plane of the barbed flange. The transverse grooves preferably extend through the barbed flange and project laterally outwardly of the flange to both sides of the flange, within the flat surface of the base beyond both sides of said barbed flange. The elastomeric protective edge member may be formed of polyvinylchloride.

DESCRIPTION OF THE PREFERRED EMBODIMENT

Figure 1:
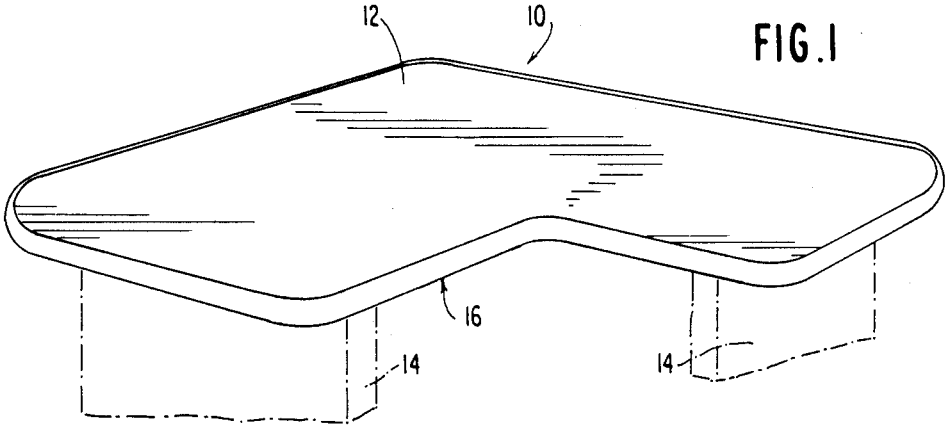
FIG. 1 is a perspective view of a desk having a flat desk top with the irregularly curved edge, provided with the improved, readily bendable extruded elastomeric trim strip mounted about an irregular curved edge of the desk top and forming a preferred embodiment of the present invention.

Referring to the drawings, the present invention has application to various articles of furniture. In FIG. 1, a desk indicated generally at 10 having a flat, horizontal desk top 12 of generally L-shaped configuration supported by a pair of vertical, upright legs shown in dotted lines at 14. The corners of the L-shaped desk top 12 are rounded or curved and to the flat, vertical edge thereof is applied a decorative and protective trim strip indicated at 16 which forms a preferred embodiment of the present invention.

Figure 2:
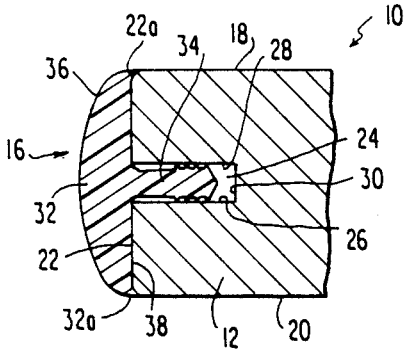
FIG. 2 is a sectional view of a portion of the desk top of FIG. 1 showing the cross-sectional configuration of the elastomeric trim strip and the method of mounting of the trim strip to the desk top edge.
Figure 3:
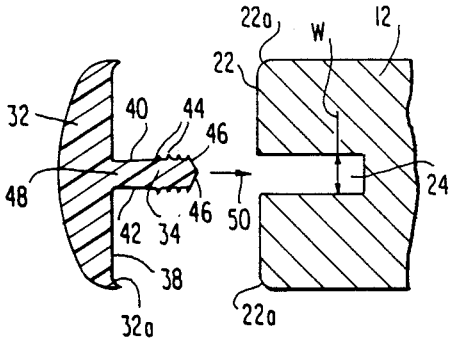
FIG. 3 is an exploded sectional view similar to that of FIG. 2 prior to attachment of the trim strip to the desk top edge.

Trim strip 16 consists of a continuously extruded, elongated elastomeric protective edge member formed preferably of a relatively soft polyvinylchloride (PVC) material which is resilient, but which may be of varying durometer hardness. As seen in FIGS. 2 and 3, the extruded elastomeric protective edge member or trim strip 16 is of mushroom shape cross-section, including a head or base 32 from the center of which extends integrally, a barbed flange 34 at right angles from a flat rear surface 38 of the head 32. Base 32 has a convex outer surface 36 facing away from the edge 22 of the desk top 12 to which it the trim strip mounted. The desk top 12 is provided with a flat top surface 18 and a co-planar flat bottom surface 20. Along edge 22, intermediate of these two surfaces and centered within the desk top edge is a relatively narrow groove 24 which extends inwardly to some depth. That depth of groove 24 is in excess of the length of the right angle projecting barbed flange 34 from base 32 of the elastomeric extrusion 16. The groove 24 within the outer edge 22 of the desk top 12 is defined by laterally opposed groove side walls 26, 28 and a groove bottom wall 30. In the illustrated embodiment the flat rear surface 38 of head 32 of the trim strip 16 terminates at opposite sides of the head, in outwardly flared rims **32*a*, conforming to the bevels 22*a*, at the top and bottom of edge 22 of the desk top 12. Due to the resilience of the PVC material forming the trim strip 16, when the barbed flange 34 is driven home within groove 24 within the desk top edge 22 the flared top and bottom rims 32*a* tend to cup the desk top 12 at bevels 22*a***.

As may be appreciated from FIG. 3, the barbed flange 34 is not of uniform thickness over its length, it tapers inwardly from the outer edge 46 of the barbed flange to provide a narrow neck 48 at the juncture of barbed flange 34 with base 32, enhancing the flexibility to the resilient barbed flange 34. Further, along the opposite sides 40, 42 of the barbed flange 34, there are integrally molded, four, right angle projecting barbs 44, which are uniformly spaced from each other over sides 40, 42 of the barbed flange. The distance between the tips of aligned barbs 44 on opposite faces 40, 42 of the barbed flange 34 is in excess of the width W of groove 24 within the desk top 12. Thus the barbs 44 are deformed and deflected during flange penetration. Further, the angulation of the barbs is such that any attempt to pull the extruded elastomeric trim strip 16 out of groove 24, opposite to the direction of insertion, as per arrow 50, FIG. 3, is resisted by the attempted straightening of the barbs 44 such that an excellent frictional fit occurs between the trim strip 16, barbed flange 34 and the desk top 12 at the opposed side walls 26 28 of slot 24 to maintain the trim strip head rear surface 38 in abutting contact with the edge 22 of the desk top after assembly, FIG. 2.

Figure 4:
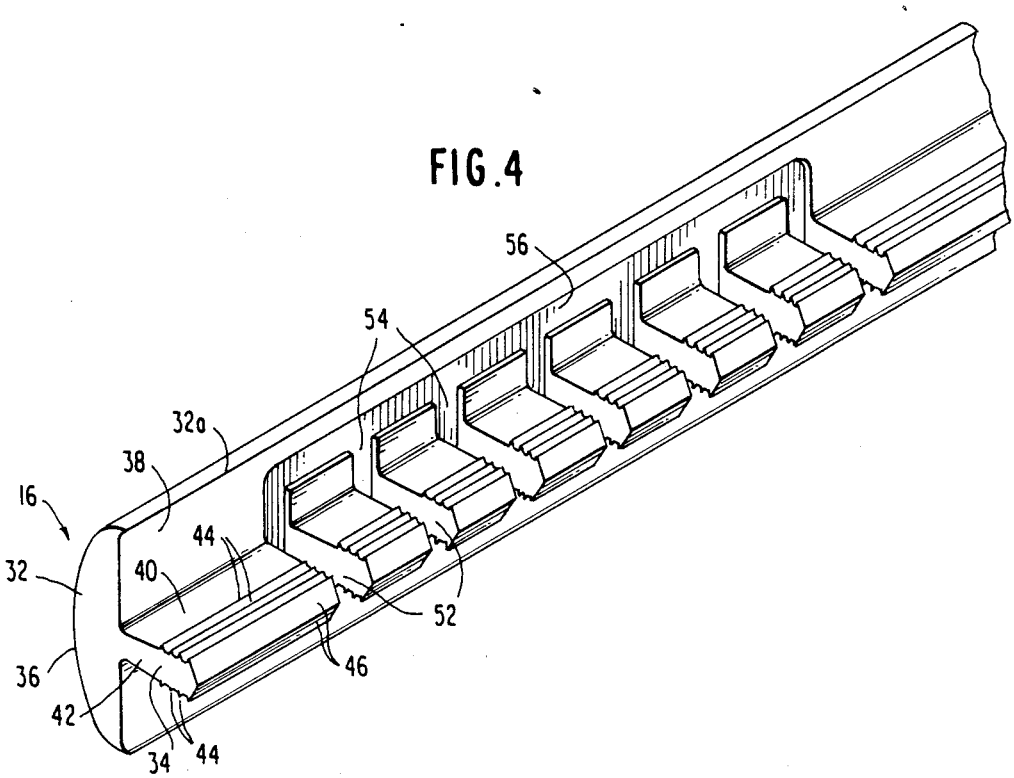
FIG. 4 is a perspective view of a portion of the trim strip applied to the desk top in FIG. 1, illustrating the longitudinal groove and transverse grooves within the base of the trim strip to enhance the bending of the strip to conform to the irregular curvature of the edge of the table of the desk top of FIG. 1.
Figure 5:
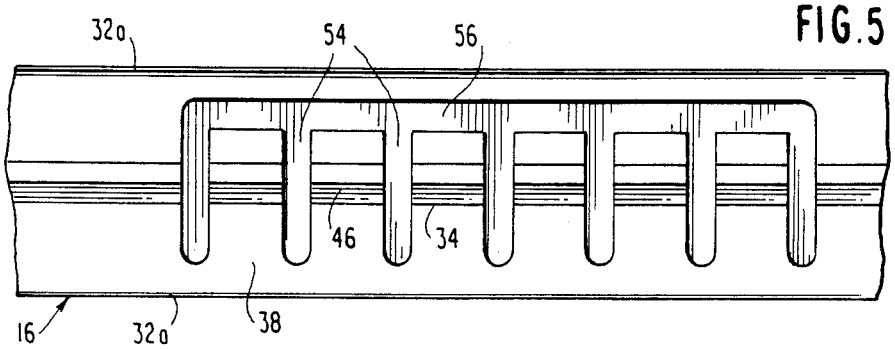
FIG. 5 is a rear elevational view of the trim strip of FIG. 4.
Figure 6:
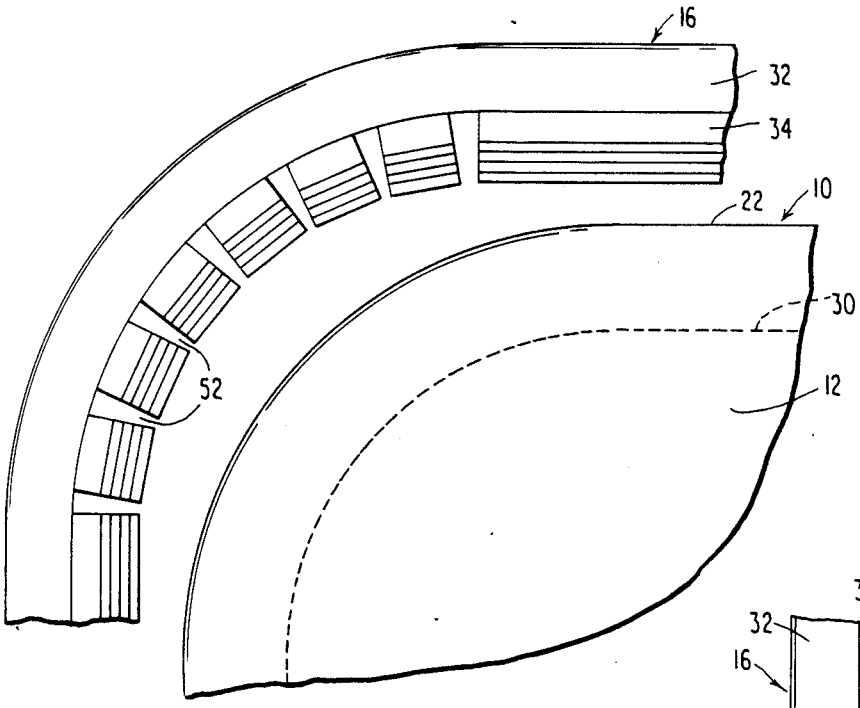
FIG. 6 is an exploded, plan view of a portion of the desk top of FIG. 1 with the trim strip curved prior to attachment to an outside corner of the desk top of FIG. 1.
Figure 7:
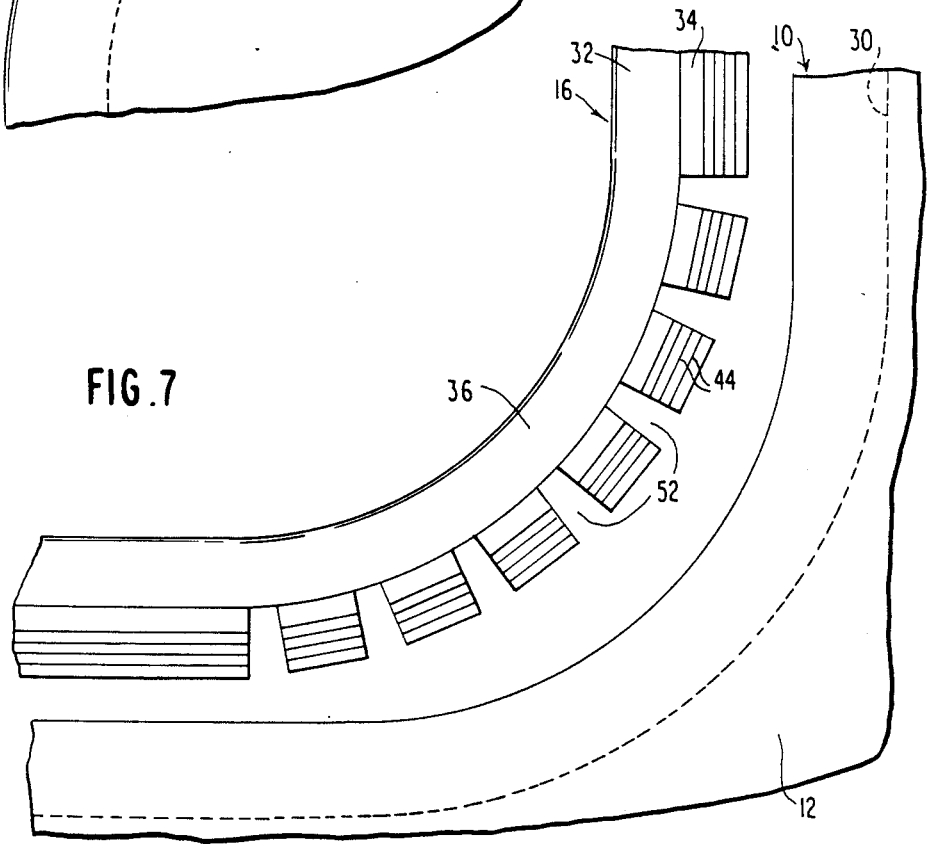
FIG. 7 is a similar exploded plan view of a portion of the desk top of FIG. 1, and of the curvature provided to a portion of the trim strip prior to attachment of the trim strip to the desk top at an inside corner of the curved edge thereof.

Reference to FIGS. 4 and 5 illustrates the improvement in enhancing the flexibility and thus the uniform bending of the extruded elastomeric trim strip 16 to conform to both inner and outer bends of edge 22 of the desk top 12 during application of the trim strip to the desk top (or other article of furniture) as illustrated in FIGS. 6 and 7. The perspective view of FIG. 4 shows the existence of a plurality of transverse slots 52 extending completely through the barbed flange 34 over the full length of the barbed flange from the V-shaped leading edge 46 towards the flat, rear surface 38 of the head or base 32 of the extruded elastomeric trim strip 16. The existence of such slots which are of rectangular cross-section in plan view, absent bending of trim strip 16, has been standard practice in this art. The presence of the same provides some ability to the trim strip 16 to flex or bend in the horizontal plane of the barbed flange 34 in both directions.

Applicant's invention recognizes that in the extrusion of the trim strip 16 the elastomeric material such as the relatively soft PVC material employed in the manufacture of the trim strip 16, hardens at the surfaces of the T-shaped cross-sectional extrusion, depending upon the nature of the resilient plastic material forming the extrusion. The surface layer in immediate contact with the dies during the thermoplastic extrusion may be harder than the core section of the elongated extruded elastomeric trim strip 16 with the core section being relatively soft and thus of a different durometer hardness than that of the surface layer as a result of contact with the extrusion die surfaces. As a result of that recognition, the applicant enhances the flexibility and thus the bendability of the trim strip irrespective of whether the trim strip takes an outer bend, as shown in FIG. 6, or an inner bend as shown in FIG. 7, conforming to the outer bend of the desk top edge and inner bend of the desk top edge respectively. Applicant has determined that providing the combination of transverse groove within the rear surface 38 of the head or base 32 of the T-shaped extruded trim strip 16 as extensions of slots 52 through the hardened surface layer of the extrusion and into the soft core, along with a longitudinal groove 56 intersecting the transverse grooves over a span of at least several of the transverse grooves.

In FIGS. 4 and 5 increases the flexibility of the T-shaped trim strip 16 thereby facilitating inside bending of the same. The transverse grooves 54 are of a width equal to the slots 52 within the barbed flange 34 and extend fully over the full width of the barbed flange 34 beyond neck 48 joining the barbed flange 34 to base 32, and within flat surface 38 to a depth of several millimeters. In the illustrated embodiment, the grooves 54 extend to beyond the opposite side walls 40, 42 of the barbed flange 34. In addition to each of the transverse grooves 54 within the flat, rear surface 38 of the base or head 32 the single longitudinally extending longitudinal groove 56 is preferably positioned to intersect the ends of the transverse grooves 54 remote from the barbed flange 34, over the full length of the elongated elastomeric trim strip 16, slotted at 52. The presence of the transverse grooves 54 and the longitudinal groove 56 intersecting the ends of the same enhances the flexibility of the extrusion in the direction of the horizontal plane of the barbed flange when bent in opposite directions for desk top edge attachment, as shown in FIGS. 6 and 7 for complying with either an outside bend, FIG. 6, or an inside bend, FIG. 7 of the desk top edge 22.

As may be appreciated, modifications and variations of the invention as described above are possible without departing from the spirit of the invention. While the slots 52 are shown as being rectangular in configuration, they may be V-shaped or take other form. While the transverse grooves 54 extend beyond both sides of the barbed flange 34, and are preferably in the form illustrated, of the same width as the transverse slots 52 within the barbed flange, they may be narrower and/or of shorter length, and solely on one side of the extruded T-shaped cross-sectional shape trim strip. The longitudinal groove 56 is shown as extending parallel to the barbed flange 34, and intersecting the transverse grooves 54 within head 32 at the ends of those grooves remote from the barbed flange. However, various modifications may be provided including sectionalizing the longitudinal groove 56 over the length of the portion of the trim strip 16 bearing the transverse slots 52 through the barbed flange 34. As mentioned previously, the durometer of the material forming the extruded trim strip 16 may vary and the chemical composition of the resilient plastic extrudant. It is to be understood, therefore, that the invention can be practiced otherwise than as specifically described, and the invention is limited only in accordance with the extent of the following claims.

What is claimed is:

1. In a trim strip of generally T-shaped cross-sectional configuration for attachment to a curved edge of an article of furniture or the like having a narrow, elongated groove within said edge, said trim strip comprising:

an elongated extruded elastomeric protective edge member, including a base with a rear surface for contact with the edge of said article of furniture and an integral barbed flange projecting outwardly of said rear surface along the length thereof, and sized slightly in excess to said elongated groove within the edge of said article of furniture for force-fitting therein, and a plurality of longitudinally spaced slots within said barbed flange over a portion of said extruded elastomeric material protective edge member, from the edge of the barbed flange remote from said base towards said base for facilitating bending of the trim strip in opposite directions in the plane of said barbed flange the improvement wherein:

said base includes a plurality of transverse grooves as extensions of said transverse slots into the rear surface of said base through said barbed flange and to at least one side thereof, and said base further includes a longitudinal groove within said rear surface extending longitudinally over a span of at least several slots, intersecting said transverse grooves and along said at least one side of said barbed flange to improve the flexibility of the elongated extruded elastomeric material protective edge member thereby preventing unevenness and puckering of said trim strip during attachment to the edge of said article of furniture and over both inside and outside bends with uniform curvature of the trim strip.

2. The trim strip as claimed in claim 1 wherein, said longitudinal groove intersects the transverse grooves within said base rear surface, at the ends of said transverse grooves remote from said barbed flange.

3. The trim strip as claimed in claim 1 wherein said elongated extruded elastomeric material protective edge member includes a surface layer of a different durometer hardness from that of a core section interiorly of said surface layer, and wherein said transverse grooves and said longitudinal grooves within said base are of a depth so as to extend through said surface layer at least to the extent of said core section.

4. The trim strip as claimed in claim 1 wherein at least the base of said elongated extruded elastomeric material protective edge member on the side opposite the surface for contact with the outer edge of said article of furniture is provided with surface graining for decorative purposes.

5. The trim strip as claimed in claim 1 wherein said elastomeric material forming said elongated extruded protective edge member is soft polyvinylchloride.

6. The trim strip as claimed in claim 1 wherein said edge of said article of furniture is flat, said elongated extruded elastomeric protective edge member has a transverse cross-sectional configuration which is mushroom shaped with said base having a convex surface facing away from said edge of said article of furniture and a generally flat rear surface for contact with the flat edge of said article of furniture.

7. The trim strip as claimed in claim 1 wherein said transverse grooves within the rear surface of said elongated extruded elastomeric protective edge member base extend beyond both sides of said barbed flange, and wherein said longitudinal groove extends over the length of the extruded edge member bearing said transverse slots through the barbed flange and intersects the ends of the transverse grooves within said base of the rear surface on one side of said barbed flange at the ends of said transverse grooves remote from said barbed flange.

* * * * *